United States Patent [19]

Currey

[11] Patent Number: 4,928,620

[45] Date of Patent: May 29, 1990

[54] SEAT PEDESTAL MOUNT

[76] Inventor: Lesley B. Currey, 122 Park St., Monticello, Ark. 71655

[21] Appl. No.: 239,407

[22] Filed: Sep. 1, 1988

[51] Int. Cl.[5] ..... B63B 29/00

[52] U.S. Cl. ..... 114/363; 297/349

[58] Field of Search ..... 297/349; 114/363, 343, 114/364, 255; 248/158, 159, 415

[56] References Cited

U.S. PATENT DOCUMENTS

| | | | |
|---|---|---|---|
| 3,593,954 | 7/1971 | Ritchie | 297/349 |
| 4,278,289 | 7/1981 | Esposito | 114/363 |
| 4,587,921 | 5/1986 | Currey | 114/363 |

*Primary Examiner*—Sherman D. Basinger
*Assistant Examiner*—Stephen P. Avila
*Attorney, Agent, or Firm*—John M. Harrison

[57] ABSTRACT

A seat pedestal mount for boats, which is characterized by strength, stability, easy of installation and convenience in maintenance. The pedestal mount includes a base plate for mounting in the deck of a boat, the base plate having a round plate flange for securing the base plate to the boat deck and a tapered bushing seat for receiving a taper lock bushing and mounting a seat pedestal extension or a seat pedestal, such that the seat pedestal extension or seat pedestal is rigidly, yet removably, mounted and stabilized in the bushing seat of the base plate. When a pedestal extension is used, the seat pedestal element of a seat frame fits into the pedestal extension and serves to mount the seat in rigid relationship on the deck of a boat. In a preferred embodiment of the invention, a specially designed, hollow pedestal extension is utilized as an element of the seat pedestal mount, with a threaded nipple provided in the bottom end of the pedestal extension, for engaging the threads of a nut seated in the base of the bushing seat, in order to further stabilize the pedestal extension in the taper lock bushing and the base plate.

13 Claims, 1 Drawing Sheet

SEAT PEDESTAL MOUNT

BACKGROUND OF THE INVENTION

1. Field of the Invention

This invention relates to pedestal-mounted seats in fishing and pleasure boats and more particularly, to a new and improved seat pedestal mount for fishing boats. In a first preferred embodiment, the seat pedestal mount of this invention is characterized by a bowl-shaped base plate having a round plate flange adapted for mounting on the deck of the boat and a tapered bushing seat extending into the deck, with a taper lock bushing fitted in the bushing seat of the base plate for rigidly receiving a pedestal extension or seat pedestal therein. In a second preferred embodiment of the invention, the bottom end of a specially designed pedestal extension is fitted with a downwardly-projecting mount nipple which is threaded to engage the threads of a nut provided in a seat slot located the bottom of the bushing seat, to further secure the pedestal extension in the bushing seat. The set pedestal element of a seat unit fits into the pedestal extension and serves to stabilize the seat unit to minimize rocking and rotating movement of the pedestal extension and the seat unit with respect to the deck of the boat.

One of the problems which exists with prior art seat pedestal mounts is that of excessive tolerance between the seat pedestal and the pedestal mount, which tolerance causes a rocking action from front to rear and from side to side, as well as a rotating motion, responsive to wave action as the boat floats. These movements are particularly aggravating under circumstances where the occupant is fishing, as they disturb the natural rhythm of bait casting and retrieving. Continued rocking from front-to-rear or side-to-side, as well as rotational movement of the seat pedestal, usually results in gradual aggravation of this motion, since the pedestal mount or seat pedestal support may be slowly "wallowed", deformed, worn or broken, thereby contributing to additional undesirable seat motion.

2. Description of the Prior Art

Typical of the prior art patents which detail seat pedestal mounts for boats is U.S. Pat. No. 4,587,921, dated May 13, 1986, to Larry B. Currey, entitled "Mounting for Boating Equipment". This patent includes a seat pedestal assembly for use on boats such as bass boats. In the Currey design, the pedestal extension has a nipple of reduced diameter, with a threaded portion thereon. The base plate includes a threaded nut which is welded to the bottom thereof for receiving the threaded portion of the nipple and securing the extension to the base plate. In another embodiment, the base plate can be threaded along substantially the entire length of the cylindrical portion thereof. Other patents which detail various types of seat pedestal mounts for boats are as follows: U.S. Pat. No. 1,224,405, dated May, 1917, to Wienstadt; U.S. Pat. No. 1,636,966, dated July, 1927 to Martin; U.S. Pat. No. 2,379,572, dated July, 1945 to Gibson; U.S. Pat. No. 2,974,625, dated March, 1961, to Lang; U.S. Pat. No. 3,151,910, dated October, 1964, to Larson; U.S. Pat. No. 3,415,475, dated December, 1968, to Goodman; U.S. Pat. No. 3,620,494, dated November, 1971, to DeGaston; U.S. Pat. No. 3,642,320, dated February, 1972, to Ward; U.S. Pat. No. 3,802,374, dated April, 1974, to Brown; U.S. Pat. No. 3,825,962, dated July, 1974, to Grounds, et al; U.S. Pat. No. 3,890,918, dated June, 1975, to Sell; U.S. Pat. No. 3,919,963, dated November, 1975, to Cox; U.S. Pat. No. 3,949,698, dated April, 1976, to Sell; U.S. Pat. No. 4,008,500, dated February, 1977, to Hall; U.S. Pat. No. 4,030,749 dated June, 1977, to Strahm; U.S. Pat. No. 4,106,143, dated August, 1978, to Lucas; and U.S. Pat. No. 4,148,465, dated April, 1979, to Bowman.

It is an object of this invention to provide a new and improved seat pedestal mount for boats and small fishing boats in particular, which seat pedestal mount includes a base plate mounted in the deck of the boat, a tapered bushing seat shaped in the base plate and a taper lock bushing fitted in the bushing seat for receiving a seat pedestal extension or seat pedestal in tight, but removable relationship, wherein the pedestal extension is designed to further receive the seat pedestal element of a seat frame, for mounting the seat in secure configuration on the boat deck.

Another object of the invention is to provide a seat pedestal mount which is substantially free of rocking and rotational movement relative to the boat deck, which seat pedestal mount is characterized in a preferred embodiment by a base plate having a plate flange adapted for mounting on a boat deck, the plate flange having a tapered bushing seat extending downwardly therefrom, for receiving a slotted taper lock bushing, wherein the taper lock bushing is designed to receive and tighten a seat pedestal or a seat pedestal extension in the base plate for securely mounting a seat in the base plate or the pedestal extension.

Yet another object of this invention is to provide a new and improved seat pedestal mount for fishing boats, which seat pedestal mount is characterized by a cast metal base plate having an outwardly-extending plate flange for mounting on a boat deck and a downwardly-extending, bowl-shaped bushing seat designed to receive a removable, flexible taper lock bushing and lock one end of a pedestal extension or a seat pedestal of a seat frame therein, wherein the seat pedestal may be mounted and secured directly in the bushing seat or in the pedestal extension in removable relationship.

Still another object of this invention is to provide a new and improved seat pedestal mount for receiving the seat pedestal of a seat frame, which seat pedestal mount further includes a base plate having a plate flange for mounting on the deck of a boat, a downwardly-extending, tapered bushing seat integrally cast with the plate flange, for receiving a removable, slotted, flexible, plastic taper lock bushing therein and a hollow pedestal extension which fits in the taper lock bushing. In a most preferred embodiment of the invention, the bottom end of the pedestal extension is fitted with a threaded nipple, for engaging a lock washer and a threaded nut located in the bushing seat and tightening the pedestal extension in the taper lock bushing to receive the seat pedestal of a seat frame in secure, but removable, relationship.

SUMMARY OF THE INVENTION

These and other objects of the invention are provided in a new and improved seat pedestal mount for use in stabilizing a seat on the deck of a boat, which seat pedestal mount is characterized in a first preferred embodiment by a metal base plate having a round top flange fitted with spaced apertures for receiving mount bolts or studs and a tapered, bowl-shaped bushing seat extending downwardly from the top flange into the boat deck, for receiving a flexible, plastic, slotted taper lock bushing therein. A seat pedestal extension or seat pedestal may be securely seated in the taper lock bushing and the bushing seat. In a second preferred embodiment of the invention, a round, hollow seat pedestal extension is provided with a downwardly-extending, threaded nipple on the bottom end and is seated in the taper lock bushing, with the threaded nipple extending through a lock washer and engaging a nut seated in the base of the bushing seat, in order to threadibly tighten the pedestal extension in the taper lock bushing and secure the seat pedestal of a seat frame inside the pedestal extension for supporting a fisherman.

BRIEF DESCRIPTION OF THE DRAWING

The invention will be better understood by reference to the accompanying drawing, wherein.

DESCRIPTION OF THE PREFERRED EMBODIMENTS

Figure 1:
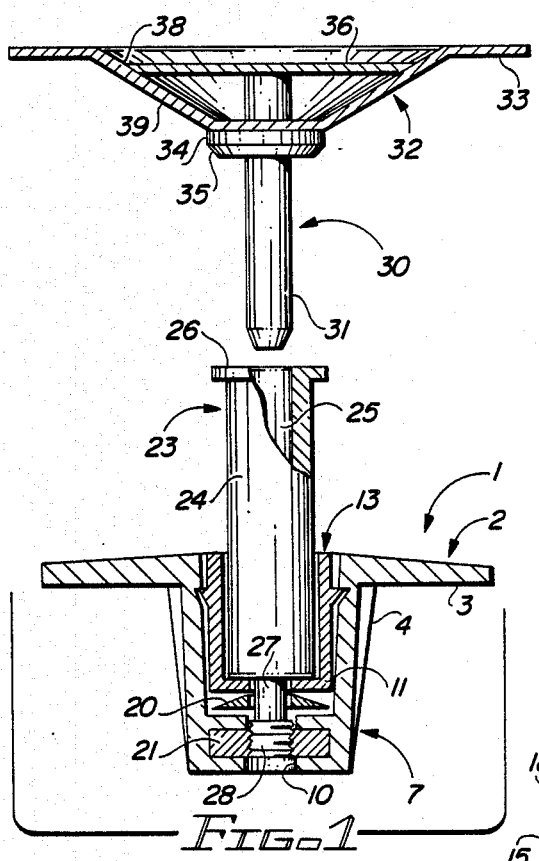
FIG. 1 is a sectional view of a preferred embodiment of the seat pedestal mount of this invention, with a seat frame illustrated in exploded configuration with respect to the seat pedestal mount.
Figure 2:
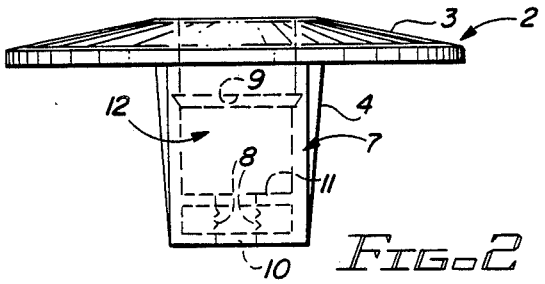
FIG. 2 is a side view of the base plate element of the seat pedestal mount illustrated in FIG. 1, more particularly illustrating a preferred internal configuration of the downwardly-extending bushing seat in phantom.
Figure 3:
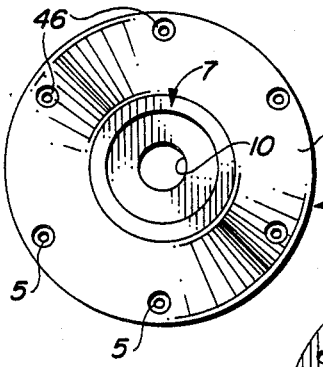
FIG. 3 is a top view of the base plate illustrated in FIG. 2.
Figure 4:
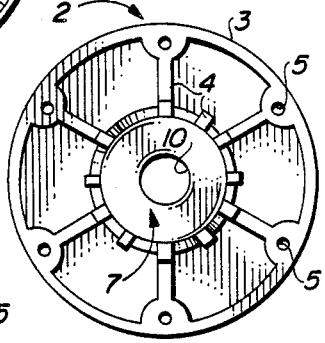
FIG. 4 is a bottom view of the base plate illustrated in FIGS. 2 and 3.
Figure 9:
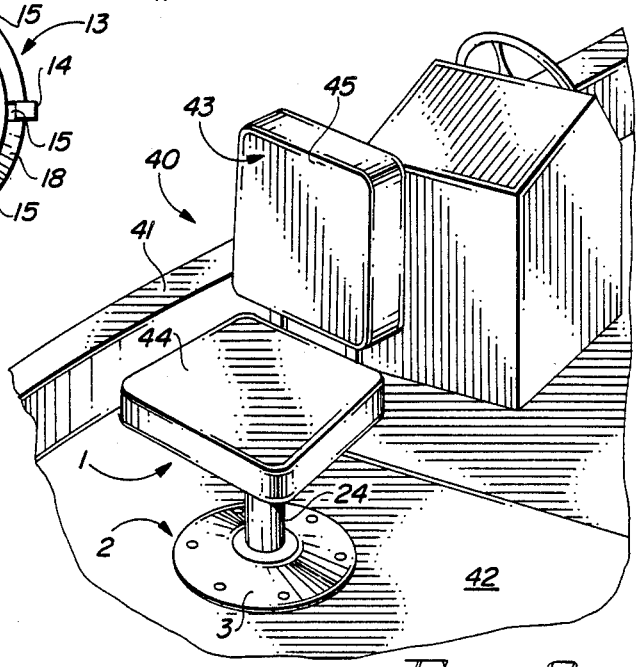
FIG. 9 is a perspective view of the seat pedestal mount secured to the deck of a fishing boat, with a seat mounted thereon in operational configuration.

Referring initially to FIGS. 1–4 and 9 of the drawings, the seat pedestal mount of this invention is generally illustrated by reference numeral 1. The seat pedestal mount 1 is characterized by a metal base plate 2, which includes an outwardly-extending, round plate flange 3, fitted with flange stiffeners 4, located on the top and bottom thereof, as further illustrated in FIG. 4. Spaced flange bolt holes 5 are provided near the periphery of the plate flange 3, as illustrated in FIGS. 3 and 4 and deck studs 46 project through the flange bolt holes 5, for receiving cooperating nuts (not illustrated) and mounting the plate flange 3 to the front deck 42 of a boat 40, as illustrated in FIG. 9. A tapered, bowl-shaped bushing seat 7 extends downwardly from the plate flange 3 to complete the base plate 2 and in a preferred embodiment of the invention, the bushing seat 7 is cast integrally with the plate flange 3, in order to provide a base plate 2 of maximum strength. As further illustrated in FIGS. 1 and 2, a seat slot 8 is cast or otherwise provided in the base of the bushing seat 7, in order to receive a nut 21, as illustrated in FIG. 1. A pair of retaining slots 9 are provided in oppositely-disposed relationship in the inside walls of the bushing seat 7, as further illustrated in FIG. 2, for a purpose which will be hereinafter further described. A bushing seat opening 10 is provided at the bottom of the bushing seat 7, which bushing seat opening 10 communicates with the hollow bushing seat interior 12 of the bushing seat 7. A seat shoulder 11 is shaped in the bushing seat interior 12 to define the seat slot 8, which is designed to receive the nut 21, as heretofore described.

As illustrated in FIGS. 1 and 5–7, a flexible taper lock bushing 13 is characterized by tapered bushing stiffeners 15 and outwardly-extending bushing tabs 14, for engaging the retaining slots 9, respectively, located in the bushing seat interior 12 of the bushing seat 7. The bushing tabs 14 project into the retaining slots 9 when the taper lock bushing 13 is seated in the bushing seat 7, in order to prevent the taper lock bushing 13 from inadvertently exiting the bushing seat 7. A bushing slot 16 extends axially through the wall of the taper lock bushing 13, to facilitate wedging of the taper lock bushing 13 tightly against the pedestal extension 23 inside the bushing seat interior 12 of the bushing seat 7, as illustrated in FIG. 1. Alternatively, the taper lock bushing 13 can be sufficiently large to directly receive a seat pedestal 31 of proper size and configuration without the requirement of a pedestal extension 23 and a bottom opening 17 is provided in the taper lock bushing 13 for drainage. A tapered bushing flange 18 extends around the top periphery of the taper lock bushing 13 and anchors the top end of the spaced bushing stiffners 15, as further illustrated in FIGS. 5–7. In a most preferred embodiment of the invention, a curved washer 20 is inserted in the bushing seat interior 12 and seats on the seat shoulder 11 therein, for locking the pedestal extension 23 or the seat pedestal 31 inside the taper lock bushing 13 and bushing seat 7, as hereinafter further described.

Referring again to FIG. 1 of the drawings, in a most preferred embodiment of the invention, the elongated pedestal extension 23 is characterized by a hollow extension tube 24, with a tube flange 26 shaped in the top thereof and provided with a downwardly-extending mount nipple 27, fitted with nipple threads 28, in the bottom end thereof. The tube bore 25 of the extension tube 24 is designed to receive a round seat pedestal 31, which is fixedly attached to the seat frame 30, as further illustrated in FIGS. 1 and 8. Accordingly, when the pedestal extension 23 is mounted in the seat pedestal mount 1, the extension tube 24 is extended into the taper lock bushing 13 and the nipple threads 28 threadibly engage the threads in the nut 21, and may extend into the bushing seat opening 10, such that the pedestal extension 23 may be tightly fitted into the taper lock bushing 13. This tightening of the extension tube 24 in the taper lock bushing 13 closes the bushing slot 16, to insure a snug and tight fit and further tightens the curved or lock washer 20 against the seat shoulder 11, such that the pedestal extension 23 is removably locked into the taper lock bushing 13 and the bushing seat 12 of the base plate 2. Removal of the pedestal extension 23 from the taper lock bushing 13 is effected by reversing the rotation of the pedestal extension 23 to unthread the mount nipple 27 from the nut 21, in a reverse operation of the installation procedure noted above. It will be appreciated that the extending end of the seat pedestal 31 may alternatively be fitted with a threaded nipple (not illustrated), in order to mount the seat pedestal 31 directly in the taper lock bushing 13 and the bushing seat 7.

Referring again to FIGS. 1 and 8 of the drawings, in another most preferred embodiment of the invention, the seat frame 30 is further characterized by a square support plate 32, which includes a flat support flange 33 on the periphery thereof and a downwardly-extending, disk-shaped middle portion 39, which flattens at the bottom to receive a mount plate 34 and a cooperating mount block 35, as further illustrated in FIG. 1. The mount plate 34 and mount block 38 are welded or otherwise secured to the seat pedestal 31 and the center section of the support plate 32 is secured to the mount plate 34. A stiffening disk 36 is located in the center of the middle portion 39 and is welded thereto, to define a flange margin 38, which extends between the support plate flange 33 and the stiffening disk 36, as further illustrated in FIG. 8. Four flange slots 37 are provided at the corners of the support plate flange 33, for mounting a support cushion 44 to the seat frame 30, as illustrated in FIG. 9.

Figure 5:
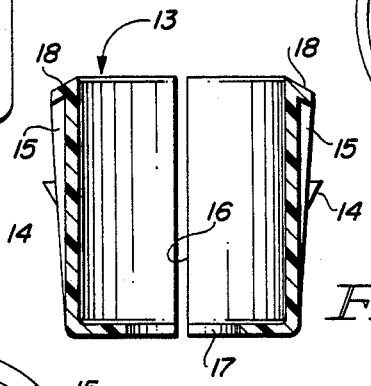
FIG. 5 is a side sectional view of a preferred slotted taper lock bushing used in connection with the base plate, more particularly illustrating a preferred internal configuration of the taper lock bushing.
Figure 6:
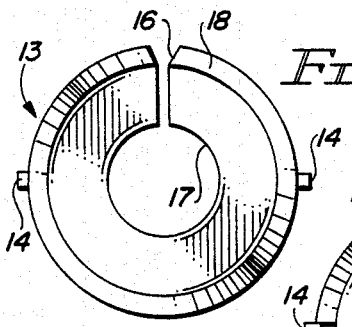
FIG. 6 is a top view of the taper lock bushing illustrated in FIG. 5.
Figure 7:
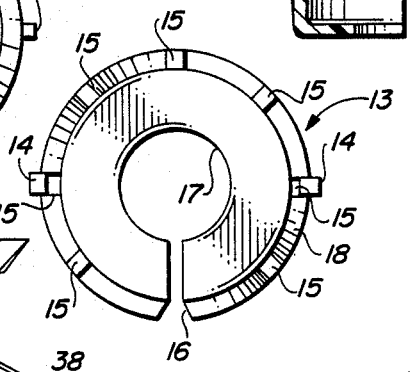
FIG. 7 is a bottom view of the taper lock bushing illustrated in FIGS. 5 and 6.

The taper lock bushing 13 illustrated in FIGS. 5–7 may be typically constructed of a suitable plastic material such as polyethylene and polypropylene, in non-exclusive particular, which may be injection molded in such sizes as may be necessary to receive and securely mount a pedestal extension 23 or a seat pedestal 31 of any desired diameter.

Figure 8:
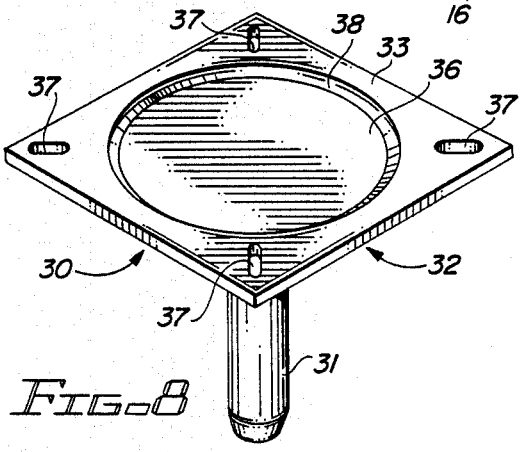
FIG. 8 is a perspective view of a preferred seat frame having a downwardly-extending seat pedestal for engaging the pedestal extension illustrated in FIG. 1.

Referring now to FIGS. 1 and 9 of the drawings, it will be appreciated that in a typical installation, the seat pedestal mount 1 of this invention is mounted to the front deck 42 of the hull 41 in the boat 40 and the seat 43 is designed to mount on the seat frame 30, illustrated in FIG. 8, as heretofore described. It is understood that the seat 43 can be designed in any conventional fashion, with the support cushion 44 attached to the support plate flange 33 of the seat frame 30 using suitable mounting fasteners (not illustrated), which register with the respective flange slots 37, as further illustrated in FIG. 8. Furthermore, a suitable backrest cushion 45 can be hinged to the support cushion 44 in conventional fashion, according to the knowledge of those skilled in the art.

It will be appreciated that the seat pedestal mount of this invention is characterized by a convenient design which is highly reliable and may support the seat pedestal directly or by means of a pedestal extension, in a stable relationship. Furthermore, the seat pedestal mount is easily maintained and can be quickly removed for maintenance and cleaning purposes. Moreover, the seat pedestal mount of this inventin can be mounted on substantially any boat of any size, but is primarily applicable to fishing boats, where the occupant may be casting and fishing for long periods of time and requires a stable platform from which to fish.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A seat pedestal mount for removably mounting a seat having a seat pedestal on a stable surface, comprising a base plate having a plate flange adapted for mounting on the stable surface; a bushing seat carried by said plate flange, said bushing seat adapted for recessing in the stable surface; a seat slot provided in said bushing seat and a nut provided in said seat slot; a seat shoulder located above said seat slot and a lock washer located on said seat shoulder; a threaded nipple projecting from the seat pedestal for threadably engaging said lock washer and said nut; and bushing means inserted in said bushing seat, whereby the seat pedestal is inserted in said bushing means and the seat is securely mounted above the stable surface.

2. The seat pedestal mount of claim 1 wherein said bushing means further comprises a flexible insert shaped to substantially conform to said bushing seat for removably locking the seat pedestal in said bushing seat.

3. The seat pedestal of claim 1 wherein said plate flange and said bushing seat are formed integrally.

4. The seat pedestal of claim 3 wherein said plate flange and said bushing seat are cast in a selected metal.

5. The seat pedestal of claim 1 wherein said bushing means further comprises a flexible plastic insert shaped to substantially conform to said bushing seat for removably seating the seat pedestal in said bushig seat.

6. The seat pedestal of claim 5 wherein said plate flange and said bushing seat are formed integrally.

7. The seat pedestal of claim 6 wherein said plate flange and said bushing seat are cast in a selected metal.

8. A seat pedestal mount for removably mounting a seat having a seat pedestal on the deck of a boat, comprising a base plate having a plate flange adapted for mounting on the deck; a bushing seat downwardly-extending

9. The seat pedestal mount of claim 8 wherein said plate flange and said bushing seat are cast in a selected metal.

10. The seat pedestal mount of claim 9 further comprising at least one retaining slot provided in said bushing seat and at least one bushing tab projecting from said flexible insert, said bushing tab adapted to engage said retaining slot and normally secure said flexible insert in said bushing seat.

11. A seat pedestal mount for removably mounting a seat having a seat pedestal on the deck of a boat, comprising a base plate having a plate flange adapted for mounting on the deck; a bushing seat downwardly-extending from said plate flange through the deck; a seat slot provided in said bushing seat and a nut provided in said seat slot; a seat shoulder located above said seat slot and a lock washer located on said seat shoulder; a flexible plastic insert seated in said bushing seat, said flexible plastic insert having an axial slot through the wall thereof and shaped substantially in the configuration of said bushing seat; and a pedestal extension having a threaded nipple projecting from one end thereof for engaging said nut and threadably seating said pedestal extension in said flexible insert and said bushing seat, and the opposite end of said pedestal extension adapted to receive the pedestal for mounting the seat in stable relationship on the deck of the boat.

12. The seat pedestal amount of claim 11 wherein said plate flange and said bushing seat are cast in a selected metal.

13. The seat pedestal mount of claim 12 further comprising at least one retaining slot provided in said bushing seat and at least one bushing tab projecting from said flexible insert, said bushing tab adapted to engage said retaining slot and normally secure said flexible insert in said bushing seat.

* * * * *